United States Patent [19]

Hattori et al.

[11] 4,385,606

[45] May 31, 1983

[54] IGNITION TIMING REGULATING DEVICE FOR INTERNAL COMBUSTION ENGINE

[75] Inventors: Tadashi Hattori, Okazaki; Kenji Goto, Susono; Daisaku Sawada, Susono; Takashi Shigematu, Susono; Hiroaki Yamaguchi, Anjo; Minoru Nishida, Okazaki, all of Japan

[73] Assignees: Nippon Soken, Inc., Nishio; Toyota Jidosha Kogyo Kabushiki Kaisha, Toyota, both of Japan

[21] Appl. No.: 262,763

[22] Filed: May 11, 1981

Related U.S. Application Data

[63] Continuation of Ser. No. 40,050, May 17, 1979, abandoned.

[30] Foreign Application Priority Data

May 25, 1978 [JP] Japan ..... 52-62692

[51] Int. Cl.[3] ..... F02P 1/00

[52] U.S. Cl. ..... 123/416; 123/146.5 A; 73/753

[58] Field of Search ..... 123/146.5 A, 407, 416, 123/417, 478, 487, 488; 73/753

[56] References Cited

U.S. PATENT DOCUMENTS

| | | | |
|---|---|---|---|
| 3,749,073 | 7/1973 | Asplund | 123/416 |
| 3,960,120 | 6/1976 | Aono et al. | 123/487 |
| 4,009,699 | 3/1977 | Hetzler et al. | 123/146.5 A |
| 4,052,967 | 10/1977 | Colling et al. | 123/416 |
| 4,128,885 | 12/1978 | Valek et al. | 123/416 |
| 4,165,650 | 8/1979 | Weissler | 73/753 |

*Primary Examiner*—P. S. Lall

*Attorney, Agent, or Firm*—Cushman, Darby & Cushman

[57] ABSTRACT

An ignition timing regulating device for use in an internal combustion engine for regulating the ignition timing of the engine depending on the pressure of ambient atmosphere. Based on the fact that the pressure in the intake manifold of the engine is equal to the pressure of ambient atmosphere in the starting stage of the engine, the output of a pressure sensor sensing the intake manifold pressure in the engine is applied to an atmospheric pressure sensing circuit so as to sense the value of atmospheric pressure in the engine starting stage, and the output of this atmospheric pressure sensing circuit is used for correcting the ignition timing of the engine.

8 Claims, 7 Drawing Figures

IGNITION TIMING REGULATING DEVICE FOR INTERNAL COMBUSTION ENGINE

This is a continuation of application Ser. No. 40,050 filed May 17, 1979, now abandoned.

BACKGROUND OF THE INVENTION

This invention relates to an ignition timing regulating device for an internal combustion engine, which senses the pressure of ambient atmosphere at, for example, the engine starting time and regulates the ignition timing of the engine on the basis of the value of sensed atmospheric pressure.

It is necessary to determine the ignition timing of an internal combustion engine depending on the state of the engine so that the engine can operate in its optimum operation mode. As is commonly known, it is the best mode of engine operation to ignite the engine under the condition of minimum advance at maximum torque or so-called MBT (minimum advance for best torque) when the factors such as the efficiency and fuel consumption of the engine are taken into account. To this end, it is necessary to change or regulate the ignition timing depending on the state of the engine so that the ignition can always occur under the condition which satisfies the MBT. This MBT is a function of the conditions of the engine and is primarily determined by main and auxiliary factors. The rotation speed of the engine and the pressure in the intake manifold are representative of the main factors, and the temperature of engine cooling water, EGR, etc. are representative of the auxiliary factors. The value of MBT is also variable depending on the value of atmospheric pressure. The value of MBT varies depending on the value of atmospheric pressure for the reason that, when the engine operates on, for example, a highland, the value of atmospheric pressure is lower than that on a lowland, that is, the volume density of air is reduced, with the result that the air-fuel ratio (A/F) in the carburetor shifts toward a richer side of the setting. According to the results of a test on a four-cylinder four-cycle internal combustion engine, the value of MBT varies relative to the value of A/F at the engine rotational frequency of 2000 rpm and the intake manifold pressure of −200 mm Hg in a manner as shown in FIG. 1. It is therefore necessary to regulate the advance so that it meets the variation in the value of MBT.

An engine ignition timing control device of electronic type has been proposed hitherto to regulate the advance so that it meets the value of MBT which varies in a manner as shown in FIG. 1. In the proposed ignition timing control device, the length of time required for the engine to make one complete revolution or to rotate through a predetermined angle is measured to detect the rotation speed of the engine, and a semiconductor type pressure sensor or a pressure responsive diaphragm is used to electrically sense the intake manifold pressure. In such an ignition timing control device, the value of advance $\alpha_N$ based on the detected rotation speed of the engine N and the value of advance $\alpha_P$ based on the sensed intake manifold pressure P are added to provide the sum $(\alpha_N+\alpha_P)$, and on the basis of this sum, the ignition timing is primarily determined. Then, various connection factors are added to finally determine the ignition timing. An atmospheric pressure sensor of diaphragm type, semiconductor type or any other suitable type is additionally employed to sense the pressure of ambient atmosphere so as to retard the advance angle of the ignition timing depending on the value of sensed atmospheric pressure. This atmospheric pressure sensor is basically the same in function as the intake manifold pressure sensor in that both of them are pressure sensors. Hitherto, both of these two pressure sensors have been provided from the standpoint that they serve individually the separate functions.

The prior art ignition timing control device of the type above described is however expensive in that it includes the atmospheric pressure sensor and the intake manifold pressure sensor in spite of the fact that these two sensors are basically the same in their functions. Further, because of the recent demands for purification of engine exhaust gases, low fuel consumption, etc., it is required to sense the atmospheric pressure with high accuracy and to suitably compensate the value of sensed intake manifold pressure for the control of the ignition timing. However, a relatively inexpensive atmospheric pressure sensor comprising the combination of a diaphragm and a switch is capable of only sensing the pressure at a single point from the structural aspect, and a plurality of such sensors corresponding to the number of pressure sensing points are required to sense the pressures at such points. Further, employment of a pressure sensor of semiconductor or like type in the device for the purpose of improvement in the accuracy of pressure sensing leads inevitably to a further higher cost. Thus, an inexpensive device which can sense the atmospheric pressure with high accuracy is now demanded.

SUMMARY OF THE INVENTION

The present invention is based on the finding that the pressure in the intake manifold of an internal combustion engine is equal to the pressure of ambient atmosphere before the engine is started or when the engine is not operating. Based upon the above finding, it is a primary object of the present invention to provide an inexpensive ignition timing regulating device for an internal combustion engine, in which the intake manifold pressure sensor serves also the function of the atmospheric pressure sensor thereby eliminating the atmospheric pressure sensor required hitherto. In the device according to the present invention, the intake manifold pressure sensor is used to sense or detect the pressure of ambient atmosphere with high accuracy before the power supply voltage is applied to the ignition system to start the engine and until the pressure in the intake manifold does not indicate the atmospheric pressure any more, and the value of sensed atmospheric pressure is suitably compensated to insure the best mode of engine operation.

In the device according to the present invention, the intake manifold pressure sensor is used to sense the pressure of ambient atmosphere before the engine is started or when the engine is not operating. Therefore, the atmospheric pressure can be sensed with high accuracy without especially requiring the atmospheric pressure sensor for ensuring the best mode of engine operation. The elimination of the atmospheric pressure sensor is advantageous in that a great reduction can be attained in the overall costs.

DESCRIPTION OF THE PREFERRED EMBODIMENT

A preferred embodiment of the ignition timing regulating device according to the present invention will now be described in detail with reference to the drawings.

Figure 1:
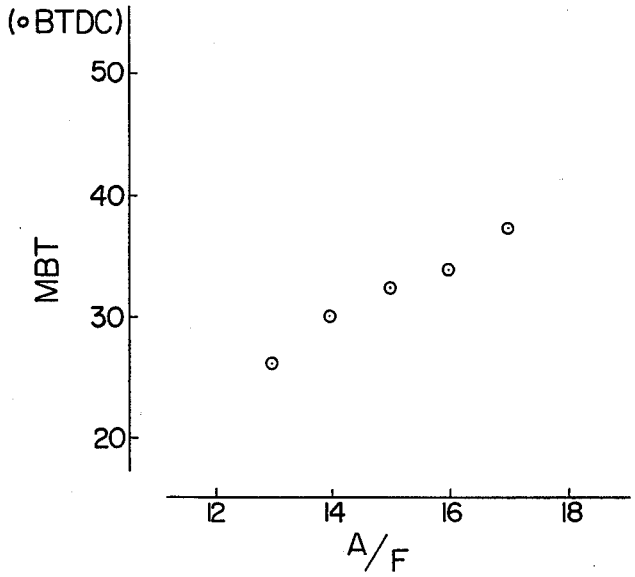
FIG. 1 is a graph illustrating the relation between the value of MBT and the value of the air-fuel ratio (A/F) in an internal combustion engine.
Figure 2:
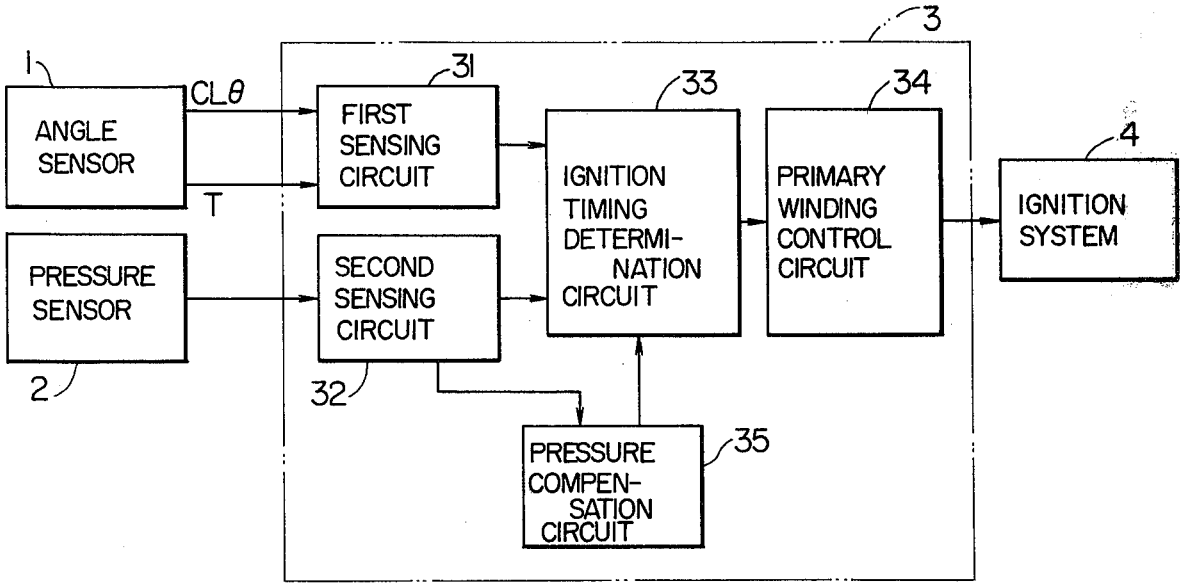
FIG. 2 is a block diagram of an embodiment of the ignition timing regulating device according to the present invention.

FIG. 2 is a block diagram showing the structure of the preferred embodiment of the present invention. Referring to FIG. 2, an angle sensor 1 is mounted on the shaft of the conventional distributor in a four-cylinder four-cycle internal combustion engine. This angle sensor 1 generates a reference signal T in the form of a train of pulses each having a predetermined pulse width $T_\theta$ corresponding to a certain angle and an angle signal $CL_\theta$ in the form of a train of pulses each having a predetermined pulse width. The pulses of the reference signal T appear at a rate of 4 per revolution of the engine, and the pulses of the angle signal $CL_\theta$ appear at a rate of 720 per revolution of the engine. A pressure sensor 2 senses the negative pressure or vacuum in the intake manifold of the engine. An ignition timing computing unit 3 is connected to the angle sensor 1 and to the pressure sensor 2 so as to determine the ignition timing depending on the state of the engine. An ignition system 4 is connected to the ignition timing computing unit 3 and ignites the individual cylinders of the engine in a sequential order at the ignition timing computed by the unit 3. The ignition timing computing unit 3 comprises a first sensing circuit 31 sensing the rotation speed of the engine or engine speed, a second sensing circuit 32 sensing the negative pressure or vacuum in the intake manifold, an ignition timing determination circuit 33 determining the ignition timing, a primary winding control circuit 34 controlling the timing of interruption of current supplied to the primary winding of the ignition coil in response to the output of the ignition timing determination circuit 33, and an atmospheric pressure compensation circuit 35.

Figure 3:
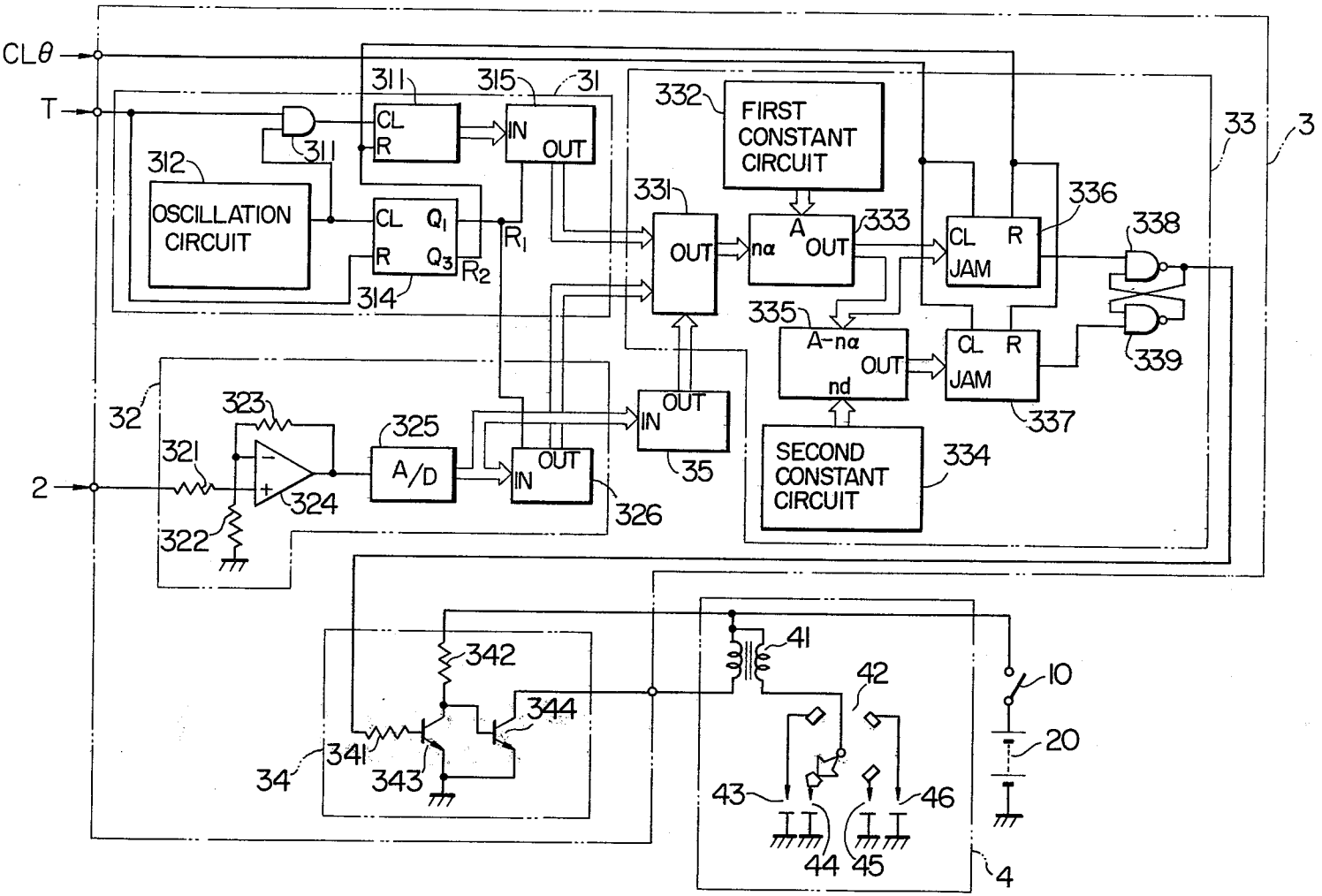
FIGS. 3, 4A and 5 are detailed electrical circuit diagrams of principal parts of the embodiment shown in FIG. 2.

The detailed structure of the device according to the present invention shown in FIG. 2 will be described with reference to FIGS. 3 to 5. Referring to FIG. 3, the first sensing circuit 31 comprises an AND circuit 311 receiving the reference signal T at one of its input terminals, an oscillation circuit 312 of known construction generating a high-frequency pulse signal, a binary counter 313, a counter 314 (which may be of the model CD4017 manufactured by the RCA Corporation and which will be referred to hereinafter as a decade counter), and a memory element 315 (which will be referred to hereinafter as a latch). The reference signal T is applied to the decade counter 314 as its reset input, while the output of the oscillation circuit 312 is applied to the decade counter 314 as its clock input. At the fall time of the pulse of the reference signal T applied from the angle sensor 1, the decade counter 314 starts to count the clock pulses applied from the oscillation circuit 312, and a train of clock pulses appear successively at its decoded output terminals. The binary counter 313 counts the clock pulses applied from the oscillation circuit 312 through the AND circuit 311 during the period of time in which the reference signal T is in its "1" level, that is, during the period of time in which the crankshaft rotates through a predetermined crank angle, and the output of the binary counter 313 during every half revolution of the engine is stored in the latch 315 so as to sense the rotation speed of the engine. The second sensing circuit 32 is connected at its input terminal to the output terminal of the pressure sensor 2 and comprises an amplifying circuit composed of resistors 321, 322, 323 and an operational amplifier 324 for amplifying the output of the pressure sensor 2, an A/D converter 325 for the analog-to-digital conversion of the amplified output of the amplifying circuit, and a latch 326 receiving the output of the A/D converter 325 for storing the digital data obtained during every half revolution of the engine so as to sense the negative pressure in the intake manifold. The output of the first sensing circuit 31 and the output of the second sensing circuit 32, that is, the signal indicative of the sensed engine rotation speed N and the signal indicative of the sensed intake manifold pressure P are applied to the ignition timing determination circuit 33.

This ignition timing determination circuit 33 comprises an ignition timing computing circuit 331 which will be described in detail later with reference to FIG. 5, and constant circuits 332 and 334 for setting a constant A and a constant $n_d$ respectively. Each of these constant circuits 332 and 334 includes, for example, a switch for setting the constant in the form of a binary-coded signal. The ignition timing determination circuit 33 further comprises a first subtracting circuit 333 of known construction for subtracting the output $n_\alpha$ of the ignition timing computing circuit 331 from the output A of the first constant circuit 332, a second subtracting circuit 335 of known construction for subtracting the output $n_d$ of the second constant circuit 334 from the output $(A-n_\alpha)$ of the first subtracting circuit 333, and a first up-down counter 336. The output $(A-n_{60})$ of the first subtracting circuit 333, the output $CL_\theta$ of the angle sensor 1, and the output of the decade counter 314 are applied to the JAM input terminal, clock input terminal and reset input terminal respectively of the first up-down counter 336, and the counter 336 counts down the count by the number $(A-n_\alpha)$. This up-down counter 336 may be of the model CD4029 manufactured by the RCA Corporation. The ignition timing determination circuit 33 further comprises a second up-down counter 337 similarly counting down its count by the number $(A-n_\alpha-n_d)$ which is the output of the second subtracting circuit 335, and a flip-flop circuit composed of a pair of NAND circuits 338 and 339 connected to the output terminals of the first and second up-down counters 336 and 337 respectively.

Figure 4A:
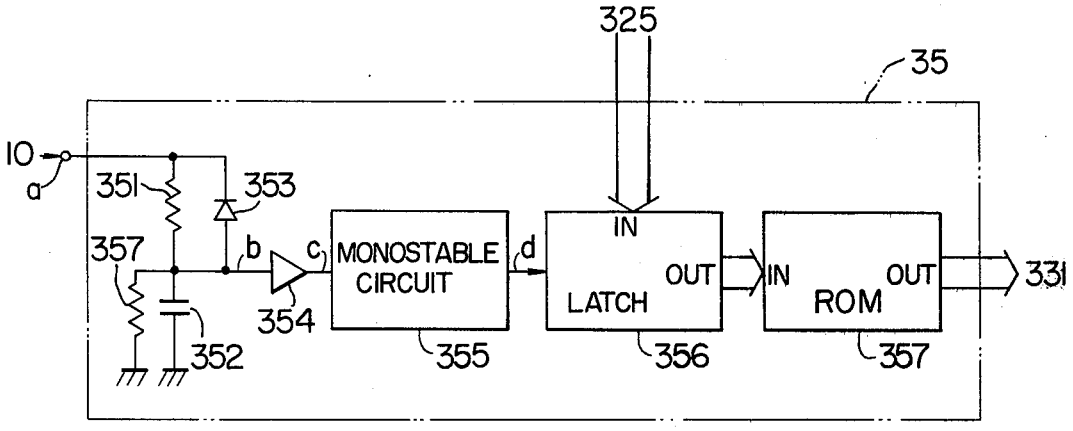
Figure 4B:
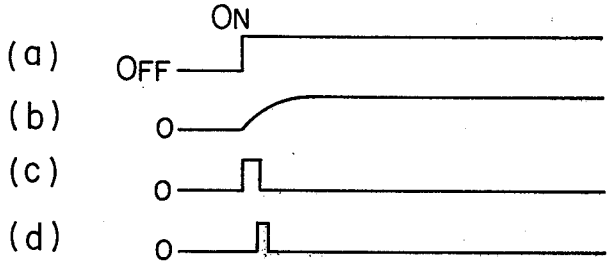
FIG. 4B is a time chart illustrating the operation of the circuit shown in FIG. 4A.

The primary winding control circuit 34 comprises resistors 341, 342 and transistors 343, 344 and acts to control the timing of interruption of current supplied to the primary winding of the ignition coil in response to the output of the ignition timing determination circuit 33. The ignition system 4 comprises an ignition coil 41, a distributor 42, and spark plugs 43, 44, 45 and 46, and a spark jumps across the spark gap of the spark plug in each cylinder in response to the interruption of the current supplied to the primary winding of the ignition coil 41. The atmospheric pressure compensation circuit 35 receives the output of the second sensing circuit 32 and applies an output signal indicative of the compensated atmospheric pressure or a signal for connection in response to atmospheric pressure to the ignition timing determination circuit 33. Its detailed circuit structure is shown in FIG. 4A. In FIG. 3, a battery 20 is shown connected to the ignition system 4 through a starter switch 10.

Figure 5:
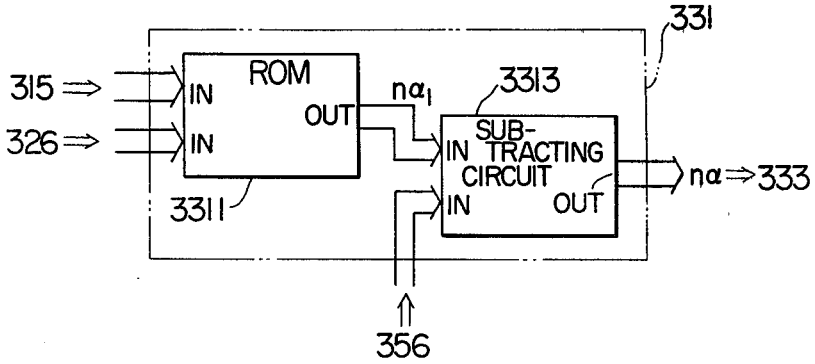

Referring to FIG. 5, the ignition timing computing circuit 331 comprises a read-only memory 3311 (referred to hereinafter as a ROM) functioning as a programming means, and a subtracting circuit 3313 for subtracting the output $n_{AP}$ of the atmospheric pressure compensation circuit 35 from the output $n_{\alpha 1}$ of the ROM 3311. The output signal $n_\alpha$ indicative of the ignition timing is applied from the ignition timing computing circuit 331 to the first subtracting circuit 333.

Referring to FIG. 4A, the atmospheric pressure compensation circuit 35 comprises a timing circuit composed of a resistor 351 connected to the key switch 10, another resistor 357, a capacitor 352 and a quick-discharge diode 353. This timing circuit delivers an output signal having a waveform as shown in (b) of FIG. 4B when the key switch 10 is turned on to provide its output having a waveform as shown in (a) of FIG. 4B. The atmospheric pressure compensation circuit 35 further comprises an amplifier or gate 354 for reshaping the output waveform of the timing circuit to provide an output signal having a waveform as shown in (c) of FIG. 4B, and a monostable circuit 355 generating a pulse having a predetermined pulse width as shown in (d) of FIG. 4B at the fall time of the output waveform of the amplifier or gate 353 shown in (c) of FIG. 4B. The atmospheric pressure compensation circuit 35 further comprises a latch 356 connected to the A/D converter 325 to store the atmospheric pressure data at the fall time of the pulse waveform shown in (d) of FIG. 4B, and a ROM 357 delivering an output signal representing the value $n_{AP}$ of the compensated atmospheric pressure in response to the output of the latch 356. The function of this atmospheric pressure compensation circuit 35 is to compute the value $n_{AP}$ of the compensated atmospheric pressure on the basis of the value of atmospheric pressure sensed by the pressure sensor 2 before the engine is started, and to apply its output signal indicative of such a value to the subtracting circuit 3313 in the ignition timing computing circuit 331 for the determination of the ignition timing.

The angle sensor 1 mounted on the distributor shaft comprises a first rotor having 4 lobes or projections, a second rotor having 720 lobes, and an electromagnetic position sensor of oscillation type each of which rotates in synchronism with the rotation of the distributor shaft. Thus, the reference signal T and the angle signal $CL_\theta$ generated by the angle sensor 1 have waveforms as shown in (a) and (b) of FIG. 6 respectively. It will be seen in (a) and (b) of FIG. 6 that each pulse of the reference signal T starts to appear at the upper dead center of the piston stroke in each cylinder and has a duration $T_\theta$ corresponding to a predetermined crank angle, and each pulse of the angle signal $CL_\theta$ has a duration corresponding to a crank angle of 1°.

Figure 6:
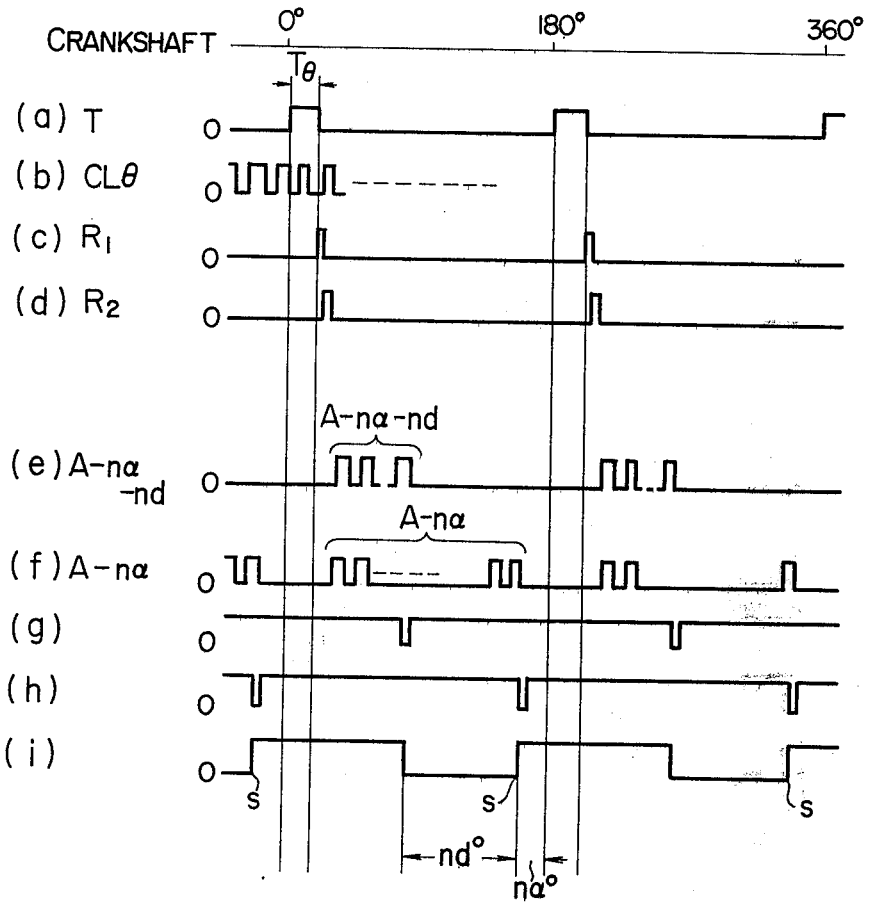
FIG. 6 is a time chart illustrating the operation of the embodiment shown in FIG. 2.

The operation of the aforementioned embodiment of the present invention will be described in detail with reference to a time chart shown in FIG. 6. From the time at which the piston in one of the cylinders reaches its upper dead center, the two pulses of the reference signal T each having the predetermined pulse width $T_\theta$ as shown in (a) of FIG. 6 appear from the angle sensor 1 while the crankshaft makes one complete revolution. At the same time, the angle signal $CL_\theta$ appears also from the angle sensor 1 and includes pulses each having the pulse width corresponding to the crank angle of 1° as shown in (b) of FIG. 6. The reference signal T is applied to the reset input terminal of the decade counter 314 in the first sensing circuit 31 in the ignition timing computing unit 3. The clock signal is continuously applied from the oscillation circuit 312 to the clock input terminal of the decade counter 314. Thus, as soon as the pulse of the reference signal T falls to its "0" level, pulse signals $R_1$ and $R_2$ as shown in (c) and (d) of FIG. 6 appear at the output terminals $Q_1$ and $Q_3$ of the decade counter 314 respectively. These signals $R_1$ and $R_2$ correspond to the first and third clock pulses of the clock signal applied after the fall time of the pulse of the reference signal T. The duration of the signal $R_2$ is made such that the time from the fall of the signal T until the fall of the signal $R_2$ is sufficiently shorter than the length of time corresponding to the crank angle of 1° in the entire region of the crankshaft rotation. The pulse signal $R_1$ is applied to the latches 315 and 326, and the pulse signal $R_2$ is applied to the reset input terminals of the binary counter 313 and up-down counters 336 and 337. The reference signal T and the clock signal are also applied to the AND circuit 311, and the number of clock pulses included in the duration $T_\theta$ of the pulse of the reference signal T is counted by the binary counter 313, and the count is stored in the latch 315 at the fall time of the pulse signal $R_1$. Therefore, the count representing the number of pulses and stored in the latch 315 is greater at lower rotation speeds of the engine.

In the second sensing circuit 32, the data of the intake manifold pressure is stored in the latch 326 at the fall time of the pulse signal $R_1$ applied thereto. The outputs of the latches 315 and 326 are applied to the ROM 3311 in the ignition timing computing circuit 331, and the ROM 3311 provides an output representing a preset value $n_{\alpha 1}$. Before the engine is started by the actuation of the starter (not shown) but after the key switch 10 is turned on, the output of the A/D converter 325 in the second sensing circuit 32, which output is indicative of the sensed intake manifold pressure, is stored in the latch 356 in the atmospheric pressure compensation circuit 35 with the timing of the waveform shown in (d) of FIG. 4B, that is, with a predetermined delay time after the turning-on of the key switch 10. The output of the latch 356 is applied to the ROM 357 to be read out as a signal representing a programmed retard data $n_{AP}$, which signal is applied to the subtracting circuit 3313 in the ignition timing computing circuit 331, and an output representing the ignition timing ($n_\alpha = n_{\alpha 1} - n_{AP}$) appears from the subtracting circuit 3313.

This ignition timing output $n_\alpha$ is applied to the first subtracting circuit 333, so that the outputs of the first and second substrating circuits 333 and 335 in the ignition timing determination circuit 33 represent ($A - n_\alpha$) and ($A - n_\alpha - n_d$) respectively. The first up-down counter 336 counts the ($A - n_\alpha$) angle pulses $CL_\theta$ from the fall time of the reset signal $R_2$ as shown in (f) of FIG. 6, and a pulse falling to its "0" level as shown in (h) of FIG. 6 appears upon completion of the counting operation. Similarly, the second up-down counter 337 counts the ($A - n_\alpha - n_d$) angle pulses $CL_\theta$ from the fall time of the reset signal $R_2$ as shown in (e) of FIG. 6, and a pulse falling to its "0" level as shown in (g) of FIG. 6 appears upon completion of the counting operation. Consequently, the flip-flop circuit composed of the NAND circuits 338 and 339 produces a pulse output signal as shown in (i) of FIG. 6. This pulse signal has a level falling to its "0" level at the fall time of the pulse shown in (g) of FIG. 6 and rising to its "1" level at the fall time of the pulse shown in (h) of FIG. 6. When the pulse signal shown in (i) of FIG. 6 is thus in its "0" level, the transistor 343 in the primary winding control circuit 34 is turned off to turn on the transistor 344 thereby supplying current to the primary winding of the ignition coil 41. The current is interrupted at the rise time of the pulse signal shown in (i) of FIG. 6, and a high voltage is induced across the secondary winding of the ignition coil 41 and is distributed by the distributor 42 to cause a spark to jump sequentially across the spark gap of the spark plugs 43, 44, 45 and 46 in the individual cylinders.

The counts of the up-down counters 336 and 337 represent the angle since each pulse in the angle signal $CL_\theta$ corresponds to the crank angle of 1°. More precisely, the angle between the fall time of the reset signal $R_2$ shown in (d) of FIG. 6 and the fall time of the pulse shown in (g) of FIG. 6 is $(A-n_\alpha-n_d)°$, and the angle between the fall time of the reset signal $R_2$ shown in (d) of FIG. 6 and the fall time of the pulse shown in (h) of FIG. 6 is $(A-n_\alpha)°$. The angle between the fall time of the pulse of the reference signal T shown in (a) of FIG. 6 and the fall time of the reset signal $R_2$ shown in (d) of FIG. 6 is less than 1°. Therefore, when the constant A is selected to be $(180-T_\theta)$, the advance $\alpha$ is given by $\alpha=n_\alpha°$, and the angle represented by the "0" level of the pulse signal shown in (i) of FIG. 6, hence, the angle through which the current is supplied to the primary winding of the ignition coil 41 is given by $n_d°$.

It will therefore be understood from the foregoing description of the embodiment of the present invention that the atmospheric pressure sensor is eliminated, and the intake manifold pressure sensor is used to sense the value of atmospheric pressure in the intake manifold as accurately as the atmospheric pressure sensor, before the engine is started.

The intake manifold pressure sensor is used to function also as the atmospheric pressure sensor as described hereinbefore in the embodiment of the present invention. Thus, the present invention is applicable to all the types of devices adapted to determine the advance by sensing the pressure in the intake manifold. The basic advance value $n_\alpha$ may be determined to be $n_\alpha=\alpha_N\alpha_P$ where $\alpha_N$ and $\alpha_P$ are the advance values based on the engine speed N and intake manifold pressure P respectively, or it may be determined from a matrix $n_\alpha=f(N,P)$, or it may be determined using suitable computation formulas. The determination may be made without using the basic advance system, and it is possible to detect the atmospheric pressure to determine the advance.

The pressure in the intake manifold is equal to the pressure of ambient atmosphere when the engine is not rotating or when the engine is rotating at a very low speed. Although the sampling is started in response to the turning-on of the key switch 10 in the specific embodiment of the present invention, it may be carried out at any desired time so far as the engine is not rotating or is rotating at a very low speed. In such an application, means for sensing the rotation speed of the engine may be provided, and the clock signal may be applied to the latch 356 in the atmospheric pressure compensation circuit 35 when the engine is not rotating or is rotating at a very low speed, so as to similarly sense the atmospheric pressure.

In the specific embodiment of the present invention, the semiconductor type of pressure sensor is employed to sense the atmospheric pressure. However, this sensor may be of any other suitable type such as a differential transformer type in which displacement of a diaphragm is electrically sensed, or an oscillator type, or a switch type.

The specific embodiment of the present invention has been described with reference to its application to the ignition system. However, the present invention is equally effectively applicable to any other system such as, for example, the fuel injection system in which both the intake manifold pressure and the atmospheric pressure are sensed for the control of fuel injection. Therefore, the present invention is also applicable to diesel engines. It will be appreciated that the present invention eliminates the atmospheric pressure sensor used hitherto for the control of the ignition system and other systems, and the intake manifold pressure sensor used for the ignition timing control can function also as the atmospheric pressure sensor for such systems.

We claim:

1. An ignition timing regulating device for use with an internal combustion engine having an intake manifold comprising:

a first sensing circuit adapted to receive a signal from a crankshaft angle position sensor for generating a speed of engine rotation signal;

a second sensing circuit, adapted to receive a pressure signal from a single intake manifold pressure sensor, for storing and periodically updating a digital signal indicative of a pressure sample;

an atmospheric pressure compensation circuit coupled to a key switch of the internal combustion engine and to the second sensing circuit for storing an initial value of intake manifold pressure before the intake manifold pressure is substantially reduced from atmospheric pressure as a result of engine operation, the atmospheric pressure compensation circuit comprising:

a timing circuit coupled to the key switch for generating a timing pulse, an initial value memory means coupled to the timing circuit and adapted to receive an output of the second sensing circuit for memorizing the initial value of manifold pressure, and a read only memory (ROM) for generating an atmospheric pressure compensation value corresponding to the initial value stored in the initial value memory means; and an ignition timing determination circuit, connected to the first sensing circuit, the second sensing circuit and the atmospheric pressure compensation circuit for repeatedly determining during operation of the engine the ignition timing as a function of engine rotation speed, intake manifold pressure, and the stored initial value of intake manifold pressure supplied by the atmospheric pressure compensation circuit.

2. A ignition timing regulating device according to claim 1 wherein the second sensing circuit comprises:

an analog amplifying circuit for amplifying the pressure signal from the single pressure sensor;

an analog to digital converter for generating a digital word indicative of a sample of the pressure signal; and a latch for repeatedly latching digital words for successive samples in response to signals from the first sensor circuit.

3. An ignition timing regulating device according to claim 2 wherein the ignition timing determination circuit is coupled to receive the rotation speed signal from the first sensing circuit, the pressure signal from the latch of the second sensing circuit and the atmospheric pressure correction value from the atmospheric pressure compensation circuit.

4. A device according to claim 1 wherein the ignition timing determination circuit includes means for determining nominal ignition timing values based on samples of engine rotation speed and intake manifold pressure and means for adjusting each such nominal value in accordance with the initial value.

5. A device according to claim 4 wherein the nominal values are obtained from a first matrix of values previously stored in a first memory wherein each pair of speed and pressure correspond to a specific nominal value.

6. A device according to claim 4 wherein the nominal values are obtained by computing them according to a predetermined mathematical formula.

7. A device according to claim 5 or 6 wherein the means for adjusting comprises means for obtaining an adjustment value from a second matrix of values previously stored in a second memory, wherein a plurality of adjustment values correspond to a plurality of values of initial pressure.

8. A device according to claim 5 or 6 wherein the means for obtaining an adjustment value are obtained by means for computing according to a predetermined mathematical formula.

* * * * *

UNITED STATES PATENT AND TRADEMARK OFFICE

CERTIFICATE OF CORRECTION

PATENT NO. : 4,385,606

DATED : May 31, 1983

INVENTOR(S) : Tadashi HATTORI, Kenji GOTO, Daisaku SAWADA, Takashi SHIGEMATU, Hiroaki YAMAGUCHI & Minoru NISHIDA It is certified that error appears in the above-identified patent and that said Letters Patent is hereby corrected as shown below:

On the title page re Priority Data [Item 30]

"May 25, 1978 [JP] Japan...52-62692 should read --May 25, 1978 [JP] ...Japan 53-62692--

Signed and Sealed this

*Tenth* Day of *January 1984*

[SEAL]

*Attest:*

GERALD J. MOSSINGHOFF

*Attesting Officer*

*Commissioner of Patents and Trademarks*